US008770800B1

(12) United States Patent
Yriberri et al.

(10) Patent No.: US 8,770,800 B1
(45) Date of Patent: Jul. 8, 2014

(54) LED-BASED LIGHT SOURCE REFLECTOR WITH SHELL ELEMENTS

(71) Applicant: Xicato, Inc., San Jose, CA (US)

(72) Inventors: John S. Yriberri, San Jose, CA (US); Christopher R. Reed, Reno, NV (US); Jim W. Li, Fremont, CA (US); Gerard Harbers, Sunnyvale, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

(21) Appl. No.: 14/204,960

(22) Filed: Mar. 11, 2014

Related U.S. Application Data

(60) Provisional application No. 61/790,794, filed on Mar. 15, 2013.

(51) Int. Cl.

| | |
|---|---|
| ***F21V 7/04*** | (2006.01) |
| ***F21K 99/00*** | (2010.01) |
| ***F21V 7/10*** | (2006.01) |
| ***F21V 13/04*** | (2006.01) |
| *F21V 7/00* | (2006.01) |

(52) U.S. Cl.
CPC ... *F21K 9/50* (2013.01); *F21V 7/10* (2013.01); *F21V 13/04* (2013.01)
USPC ..... 362/302; 362/297; 362/303

(58) Field of Classification Search
CPC ..... F21S 48/1341; F21S 48/1347; F21S 48/1352; F21S 8/12; F21V 7/0025; F21V 7/0033; F21V 7/0041
USPC ..... 362/296.1, 297, 249.01–249.06, 268, 362/290–292, 302–303
See application file for complete search history.

(56) References Cited

U.S. PATENT DOCUMENTS

| | | | | |
|---|---|---|---|---|
| 1,309,449 | A * | 7/1919 | Otte | 362/291 |
| 1,478,898 | A * | 12/1923 | Hachman | 362/291 |
| 5,959,316 | A | 9/1999 | Lowery | |
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,207,697 | B2 * | 4/2007 | Shoji | 362/319 |
| 7,250,715 | B2 | 7/2007 | Mueller et al. | |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 8,485,692 | B2 | 7/2013 | Li | |
| 2007/0081336 | A1 | 4/2007 | Bierhuizen et al. | |
| 2012/0069547 | A1 * | 3/2012 | Gielen et al. | 362/84 |
| 2013/0194808 | A1 * | 8/2013 | Guercio et al. | 362/296.08 |

* cited by examiner

*Primary Examiner* — Karabi Guharay
*Assistant Examiner* — Nathaniel Lee
(74) *Attorney, Agent, or Firm* — Silicon Valley Patent Group LLP

(57) ABSTRACT

An optical element that may be replaceably mounted to an LED based illumination device. The optical element includes a hollow shell reflector and a plurality of annular shell elements disposed within the hollow shell reflector at different distances from the input port of the optical element. An annular shell element that is closer to the input port of the optical element has a radius that is less than the radius of an annular shell element farther from the input port.

20 Claims, 14 Drawing Sheets

LED-BASED LIGHT SOURCE REFLECTOR WITH SHELL ELEMENTS

CROSS REFERENCE TO RELATED APPLICATIONS

This application claims priority under 35 USC 119 to U.S. Provisional Application No. 61/790,794, filed Mar. 15, 2013, which is incorporated by reference herein in its entirety.

TECHNICAL FIELD

The described embodiments relate to optical elements used with illumination modules that include Light Emitting Diodes (LEDs), and more particularly to optical elements that serve as reflectors for illumination modules.

BACKGROUND

The use of LEDs in general lighting is becoming more common, but poor color quality and poor color rendering remain as issues. Illumination devices that combine a number of LEDs may be used to improve the color quality and rendering, but suffer from spatial and/or angular variations in the color. Moreover, illumination devices that use LEDs sometimes are limited in the resulting emission patterns.

SUMMARY

An optical element that may be replaceably mounted to an LED based illumination device. The optical element includes a hollow shell reflector and a plurality of annular shell elements disposed within the hollow shell reflector at different distances from the input port of the optical element. An annular shell element that is closer to the input port of the optical element has a radius that is less than the radius of an annular shell element farther from the input port.

In one configuration, an apparatus includes an LED based illumination device operable to emit light in a Lambertian pattern over a surface of an output window; and an optical element coupled to receive the light emitted from the output window of the LED based illumination device, the optical element having an input port and an output port, wherein a perimeter of the optical element increases in size from the input port to a maximum perimeter, the optical element comprising: a hollow shell reflector having a first height; a first annular shell element having a first radius and a second height that is less than the first height, the first annular shell element disposed within the hollow shell reflector; and a second annular shell element having a second radius and a third height, the second annular shell element disposed within the hollow shell reflector at a location closer to the input port of the optical element than a location of the first annular shell element, wherein the second radius is less than the first radius.

In one configuration, an optical element includes an input port configured to receive light emitted from a planar light emitting area of an LED based illumination device; an output port configured to emit an amount of light; a hollow shell reflector having a first height; a first annular shell element having a first radius and a second height that is less than the first height, the first annular shell element disposed within the hollow shell reflector; and a second annular shell element having a second radius and a third height that is less than the first height, the second annular shell element disposed within the hollow shell reflector at a location closer to the input port of the optical element than a location of the first annular shell element, wherein the second radius is less than the first radius.

In one configuration, an optical element includes an input port configured to receive light emitted from a planar light emitting area of an LED based illumination device; an output port configured to emit an amount of light; a hollow shell reflector having a first height; a first annular shell element having a first diameter and a second height that is less than the first height; a curved, annular shell element having a second diameter that is less than the first diameter, and a third height that is greater than the second height and less than the first height; a second annular shell element having a third diameter that is less than the second diameter and a fourth height that is less than the third height, wherein the curved annular shell element and the first and second annular shell elements are disposed within the hollow shell reflector.

Further details and embodiments and techniques are described in the detailed description below. This summary does define the invention. The invention is defined by the claims.

DETAILED DESCRIPTION

Reference will now be made in detail to background examples and some embodiments of the invention, examples of which are illustrated in the accompanying drawings.

Figure 1:
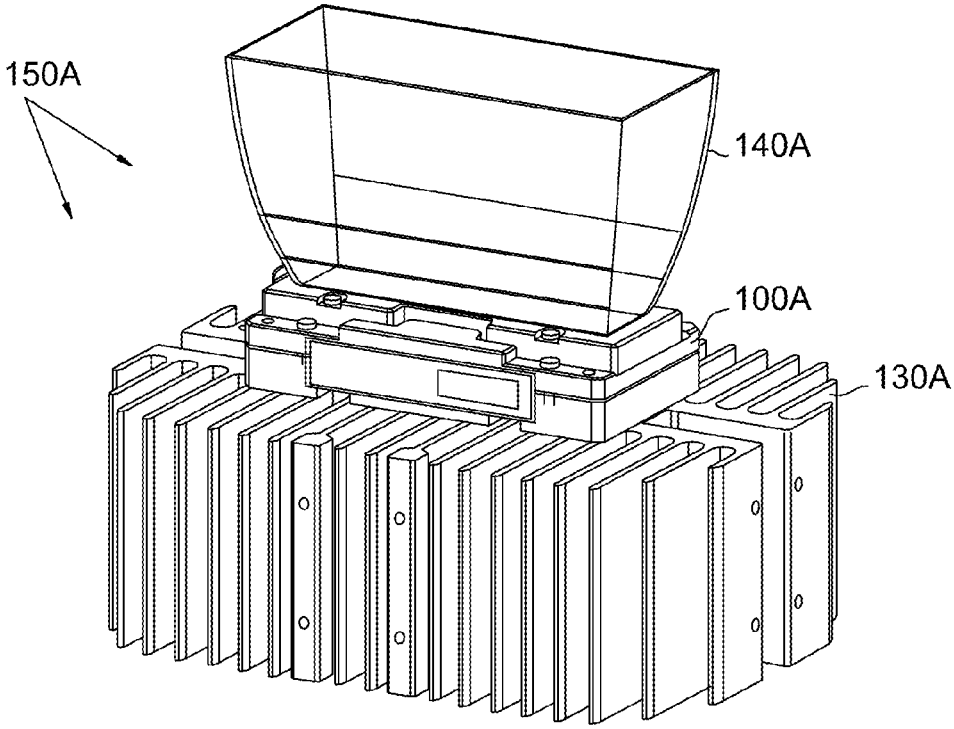
FIGS. 1, 2, and 3 illustrate three exemplary luminaires, including an illumination device, optical element, and light fixture.
Figure 2:
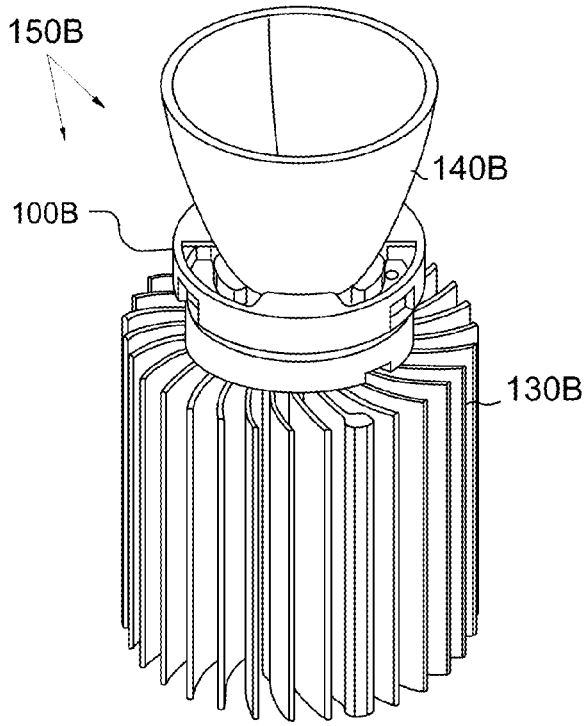
Figure 3:
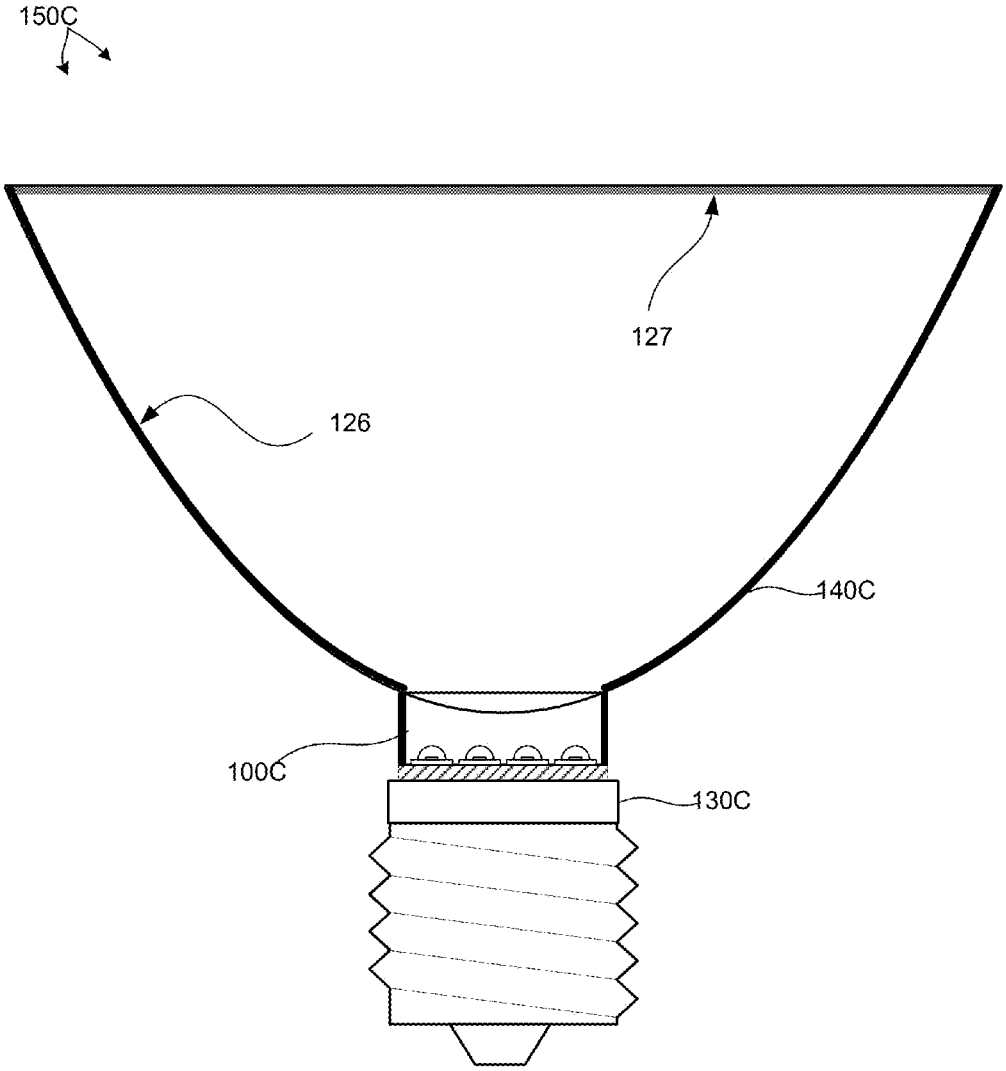

FIGS. 1, 2, and 3 illustrate three exemplary luminaires, respectively labeled 150A, 150B, and 150C (sometimes collectively or generally referred to as luminaire 150). The luminaire 150A illustrated in FIG. 1 includes an illumination module 100A with a rectangular form factor. The luminaire 150B illustrated in FIG. 2 includes an illumination module 100B with a circular form factor. The luminaire 150C illustrated in FIG. 3 includes an illumination module 100C integrated into a retrofit lamp device. These examples are for illustrative purposes. Examples of illumination modules of general polygonal and elliptical shapes may also be contemplated. FIG. 1 illustrates luminaire 150A with an LED based illumination module 100A, optical element 140A, and light fixture 130A. FIG. 2 illustrates luminaire 150B with an LED based illumination module 100B, optical element 140B, and light fixture 130B. FIG. 3 illustrates luminaire 150C with an LED based illumination module 100C, optical element 140C, and light fixture 130C. For the sake of simplicity, LED based illumination module 100A, 100B, and 100C may be collectively referred to as illumination module 100, optical element 140A, 140B, and 140C may be collectively referred to as optical element 140, and light fixture 130A, 130B, and 130C may be collectively referred to as light fixture 130. As depicted, light fixture 130 includes a heat sink capability, and therefore may be sometimes referred to as heat sink 130. However, light fixture 130 may include other structural and decorative elements (not shown). Optical element 140 is mounted to illumination module 100 to collimate or deflect light emitted from illumination module 100. The optical element 140 may be made from a thermally conductive material, such as a material that includes aluminum or copper and may be thermally coupled to illumination module 100. Heat flows by conduction through illumination module 100 and the thermally conductive optical element 140. Heat also flows via thermal convection over the optical element 140. Optical element 140 may be a compound parabolic concentrator, where the concentrator is constructed of or coated with a highly reflecting material. Optical elements, such as a diffuser (not shown) or optical element 140 may be removably coupled to illumination module 100, e.g., by means of threads, a clamp, a twist-lock mechanism, or other appropriate arrangement. As illustrated in FIG. 3, the optical element 140C may include sidewalls 126 and a window 127 that are optionally coated, e.g., with a wavelength converting material, diffusing material or any other desired material.

As depicted in FIGS. 1, 2, and 3, illumination module 100 is mounted to heat sink 130. Heat sink 130 may be made from a thermally conductive material, such as a material that includes aluminum or copper and may be thermally coupled to illumination module 100. Heat flows by conduction through illumination module 100 and the thermally conductive heat sink 130. Heat also flows via thermal convection over heat sink 130. Illumination module 100 may be attached to heat sink 130 by way of screw threads to clamp the illumination module 100 to the heat sink 130. To facilitate easy removal and replacement of illumination module 100, illumination module 100 may be removably coupled to heat sink 130, e.g., by means of a clamp mechanism, a twist-lock mechanism, or other appropriate arrangement. Illumination module 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
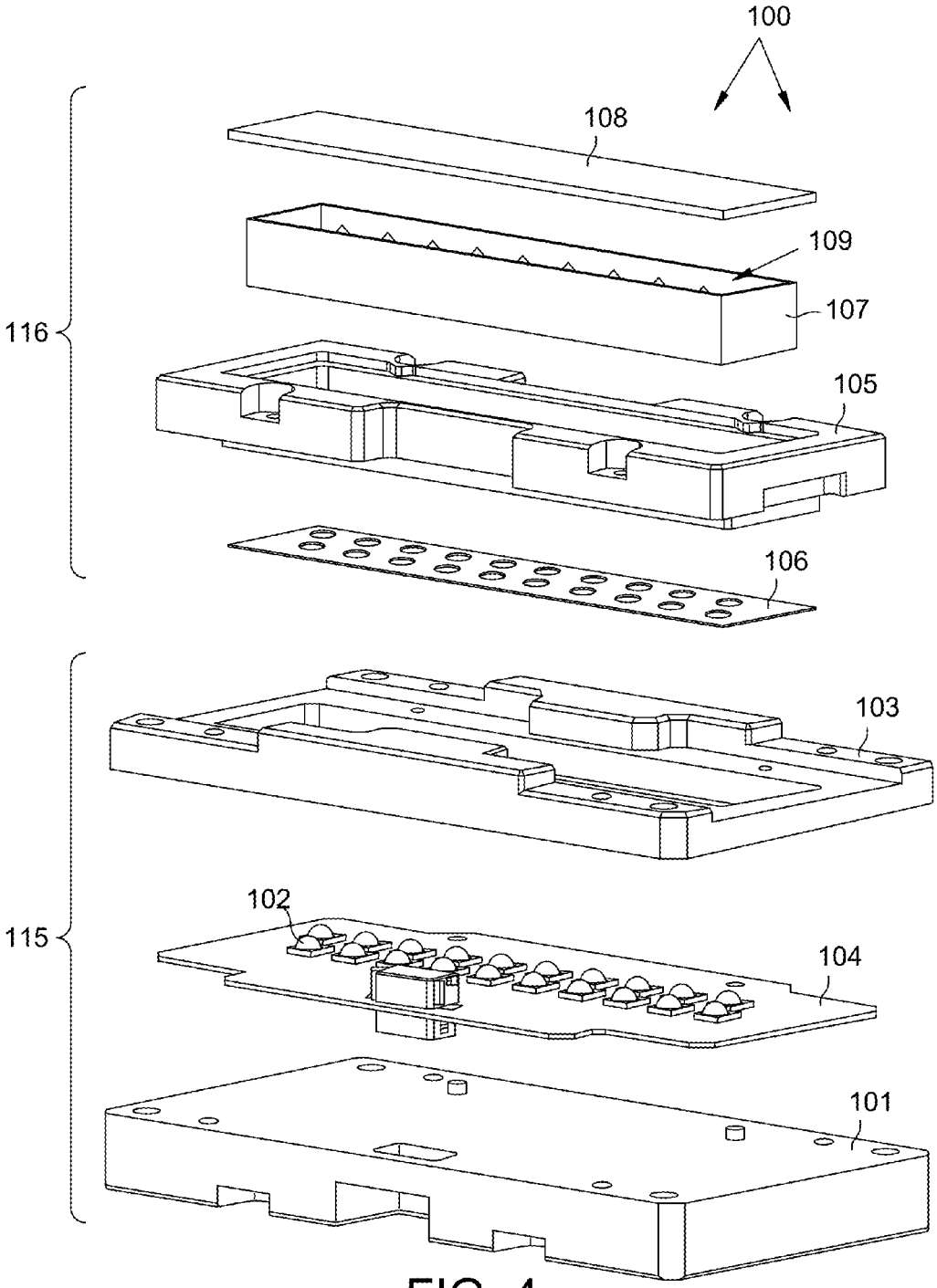
FIG. 4 illustrates an exploded view of components of an LED based illumination module.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 may include a bottom reflector 106 and sidewall 107, which may optionally be formed from inserts. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a polytetrafluoroethylene (PTFE) material. In some examples inserts 106 and 107 may be made from a PTFE material of one to two millimeters thick, as sold by W.L. Gore (USA) and Berghof (Germany). In yet other embodiments, inserts 106 and 107 may be constructed from a PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide ($TiO_2$), zinc oxide (ZnO), and barium sulfate ($BaSO_4$) particles, or a combination of these materials.

Figure 5A:
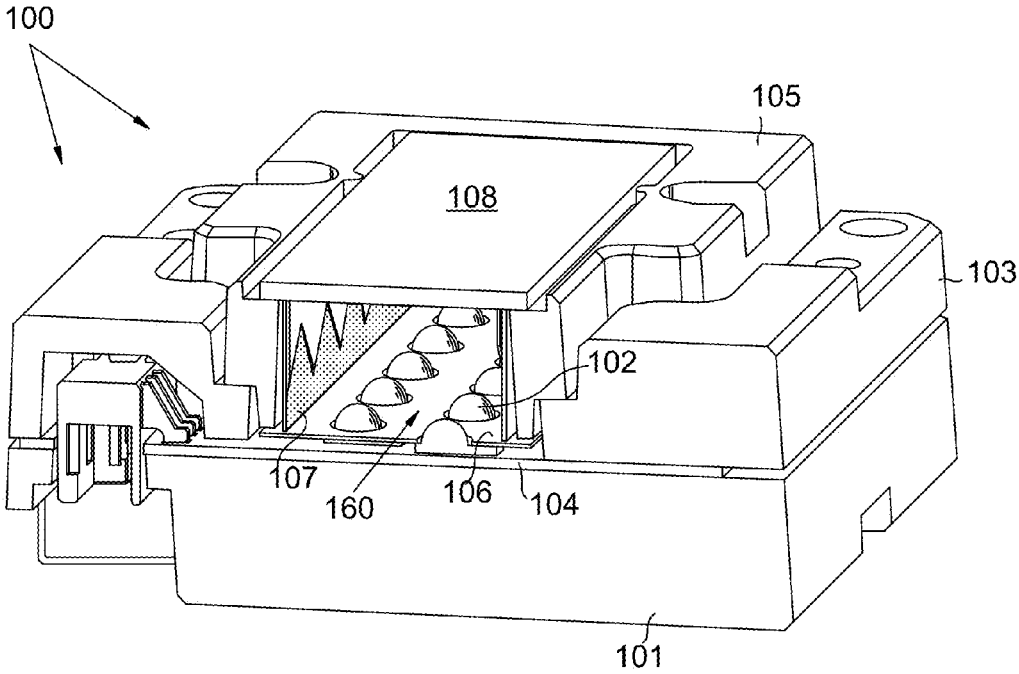
FIGS. 5A and 5B illustrate perspective and cross-sectional views of an LED based illumination module.
Figure 5B:
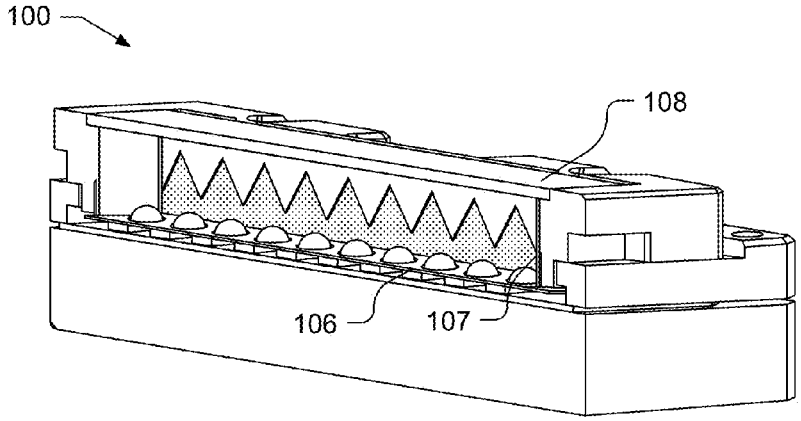

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a color conversion cavity 160 (illustrated in FIG. 5A) in the LED based illumination module 100. A portion of light from the LEDs 102 is reflected within color conversion cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

LEDs 102 can emit different or the same colors, either by direct emission or by phosphor conversion, e.g., where phosphor layers are applied to the LEDs as part of the LED package. The illumination device 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. The light emitted from the illumination device 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical properties and/or physical properties (such as thickness or concentration) of the wavelength converting materials and the geometric properties of the coatings on the interior surfaces of cavity 160, specific color properties of light output by output window 108 may be specified, e.g. color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S_4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr, Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$:Ce, and $Lu_3Ga_5O_{12}$:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g. (Sr, Ca)AlSiN3:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of color conversion cavity 160, the color point of the light emitted from the module can be tuned as desired.

As depicted in FIGS. 1-3, light generated by LEDs 102 is generally emitted from color conversion cavity 160, exits the output window 108, interacts with optical element 140, and exits luminaire 150. In one aspect, a relatively compact optical element is introduced herein to generate a narrow beam angle from luminaire 150.

Figure 6:
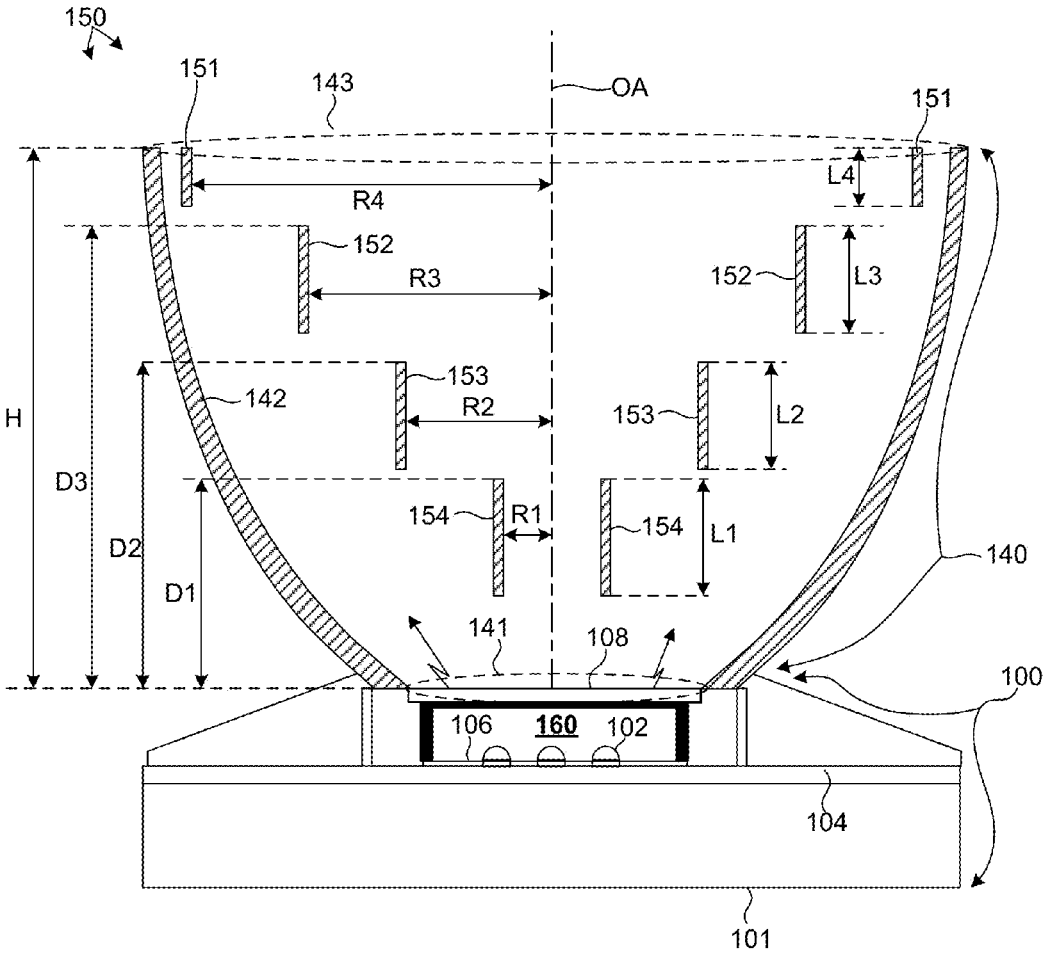
FIG. 6 is illustrative of a cross-sectional, side view of a luminaire including an optical element having a hollow shell reflector and a plurality of annular shell elements disposed within the hollow shell reflector at different distances from the input port of the optical element.

FIG. 6 is illustrative of a cross-sectional, side view of luminaire 150 in one embodiment. As illustrated, luminaire 150 includes LED based illumination module 100 and optical element 140. As depicted, LED based illumination module 100 has a circular shape (e.g., as illustrated in FIG. 2), however other shapes (e.g., as illustrated in FIG. 1) may be contemplated.

LEDs 102 of LED based illumination module 100 emit light directly into color conversion cavity 160. Light is mixed and color converted within color conversion cavity 160 and the resulting light is emitted by LED based illumination module 100. The light is emitted in a Lambertian pattern over an extended surface (i.e., the surface of output window 108). As depicted in FIG. 6, the emitted light passes through output window 108 and enters input port 141 of optical element 140.

Optical element 140 includes an input port 141, hollow shell reflector 142, and output port 143. As depicted in FIG. 6, the perimeter of the optical element 140 increases in size from a perimeter at the input port to a maximum perimeter. As depicted, hollow shell reflector has a height, H. In addition, optical element 140 includes a number of annular shell elements 151-154 located within the volume of hollow shell reflector 142. The annular shell elements 151-154 may be centered on an optical axis, OA, of the luminaire 150. Annular shell element 154 has a radius, R1, from the optical axis and a height, L1. The top of annular shell element 154 is located a distance, D1, from the input port of optical element 140. Annular shell element 153 has a radius, R2, and a height, L2. The top of annular shell element 153 is located a distance, D2, from the input port of optical element 140. Annular shell element 152 has a radius, R3, and a height, L3. The top of annular shell element 152 is located a distance, D3, from the input port of optical element 140. Annular shell element 151 has a radius, R4, and a height, L4. The top of annular shell element 154 is located a distance, H, from the input port of optical element 140.

As described herein with reference to specific embodiments illustrated in FIGS. 5-19, shell elements, such as shell elements 151-154, are described as annular shell elements due to the circular shape of the underlying LED based illumination modules presented in these embodiments. However, in general, shell elements of differing shapes (e.g., square shell elements, rectangular shell elements, ellipsoidal shell elements, etc.) may be contemplated within the scope of this patent document.

Thin, shell elements and hollow shell reflectors having minimal thickness variations are preferred to promote ease of manufacture by a molding process. In some embodiments, the thickness of the shell elements described herein vary between 0.5 millimeters and one millimeter in thickness. In some embodiments, the thickness of the shell elements described herein vary between 0.7 millimeters and 0.9 millimeters in thickness. In some embodiments, the thickness of the hollow shell reflectors described herein vary between one millimeter and three millimeters in thickness. In some embodiments, the thickness of the shell elements described herein vary between 1.5 millimeters and 2.5 millimeters in thickness.

In one aspect, the height of annular shell element 154 is greater than the height of annular shell element 151, the radius of annular shell element 154 is less than the radius of annular shell element 151, and annular shell element 154 is located closer to the input port 141 of optical element 140 than annular shell element 151.

Figure 7:
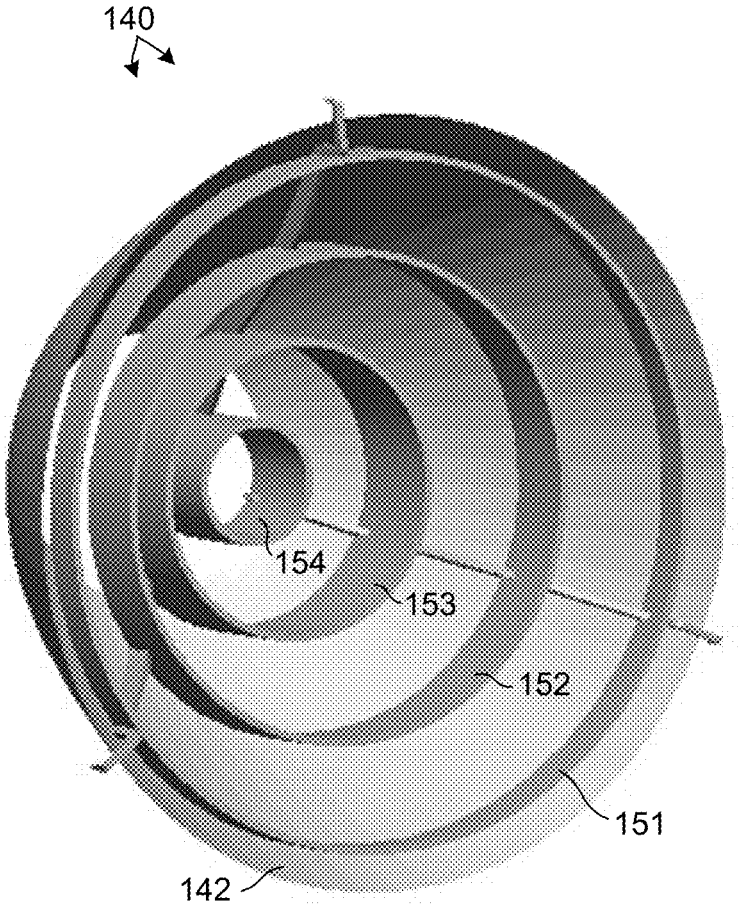
FIG. 7 is a perspective view of the optical element depicted in FIG. 6.

FIG. 7 is a perspective view of optical element 140 depicted in FIG. 6 for illustrative purposes.

Figure 8:
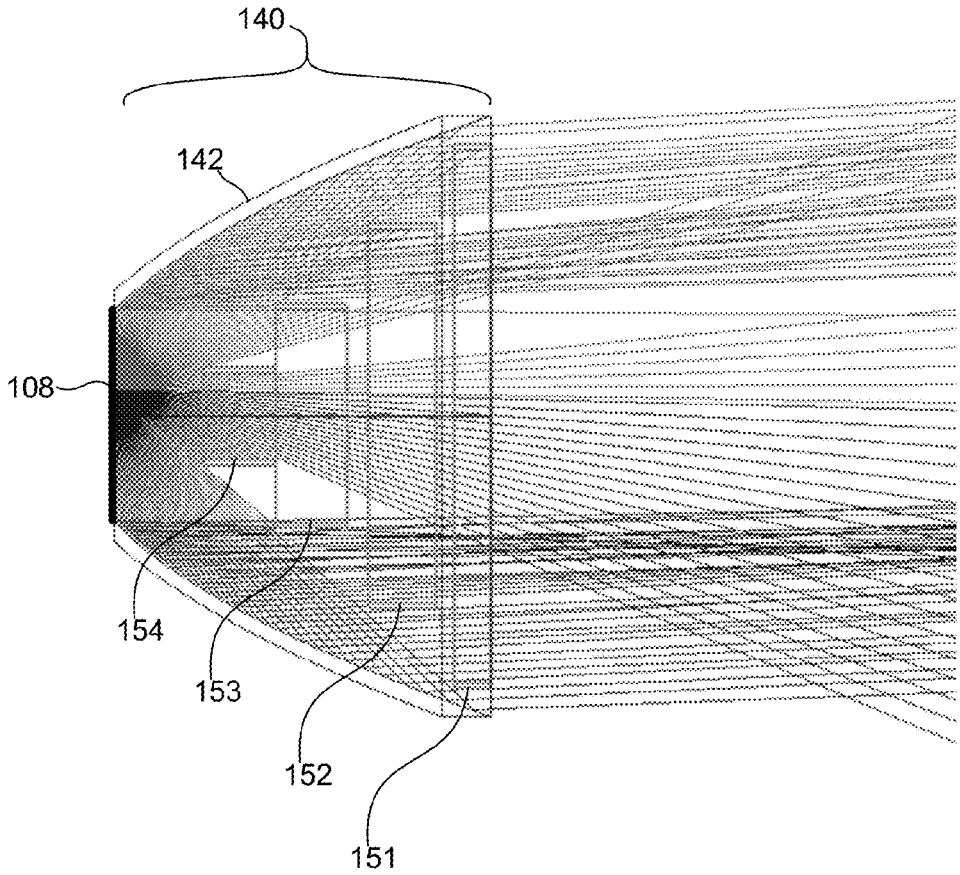
FIG. 8 is a plot illustrating a ray trace diagram of the optical element depicted in FIG. 6.

FIG. 8 is a plot illustrating a ray trace diagram of optical element 140 depicted in FIG. 6. As depicted, light is emitted from optical element 140 over a narrow beam angle despite an approximately Lambertian emission from the surface of output window 108. A portion of light emitted from output window 108 is emitted at large angles and is directly incident on hollow shell reflector 142. Although a portion of the light directly incident on hollow shell reflector 142 is redirected out of optical element 140 within a narrow beam angle, a portion of the light reflected from the surface of hollow shell element 142 is incident on one of annular shell elements 151-154. In one example, the surfaces of annular shell elements 151-154 are absorptive (e.g., coated with or constructed from a black colored material) and the incident light is absorbed. This effectively limits the amount of light that escapes from optical element 140 at large angles. In another example, the surfaces of annular shell elements 151-154 are treated to generate an asymmetric reflection such that the incident angle and the angle of reflected light are not the same. In this manner, an additional collimating effect on the light emitted from optical element 140 is achieved. In some examples, the surfaces of annular shell elements 151-154 are any combination of specularly reflective surfaces, asymmetrically reflective surfaces, and absorbtive surfaces.

Figure 9:
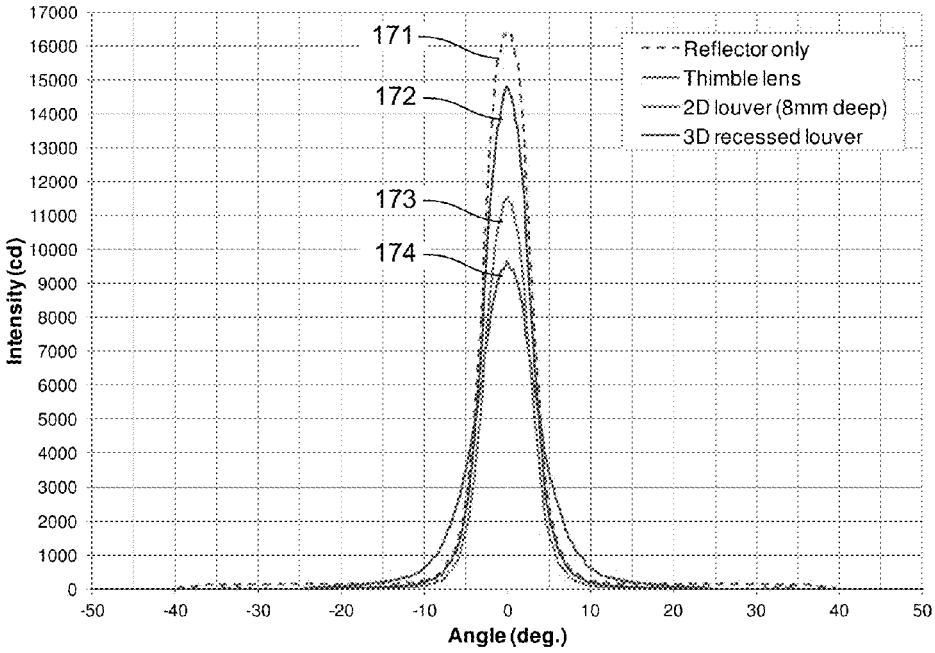
FIG. 9 is a plot illustrative of the intensity over beam angle for a number of different scenarios.

FIG. 9 is a plot illustrative of the intensity over beam angle for a number of different scenarios. Plotline 171 illustrates the intensity over beam angle for an optical element that includes hollow shell reflector 142 without any additional annular shell elements. Plotline 172 illustrates the intensity over angle for optical element 140 illustrated in FIGS. 6-8. Plotline 173 illustrates the intensity over beam angle for an optical element that includes a hollow shell reflector similar to hollow shell reflector 142, except that the hollow shell reflector has been shortened to accommodate a conventional "snoot" optic having eight millimeters in length. Plotline 174 illustrates the intensity over angle for an optical element 140 that includes hollow shell reflector 142 and a "thimble" lens element. Such a "thimble" lens element is described in U.S. Pat. Application No. U.S. patent application Ser. No. 13/601,276 entitled "LED-Based Light Source with Sharply Defined Field Angle," assigned to Xicato, Inc., which is incorporated herein by reference in its entirety. As illustrated, the intensity achieved using optical element 140 including annular shell elements within the volume of hollow shell reflector 142 is higher than a conventional "snoot" design or a "thimble" design.

Figure 10:
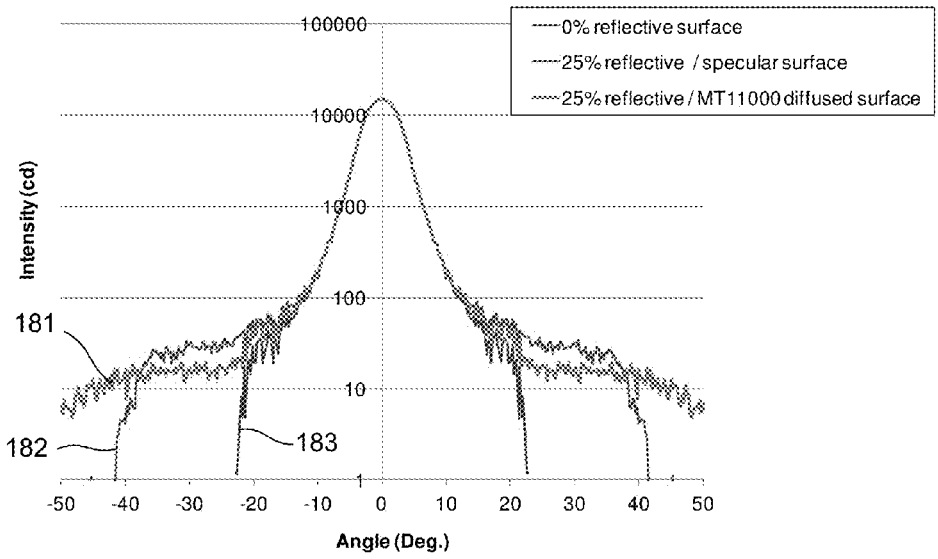
FIG. 10 depicts another plot of intensity over beam angle for several different embodiments of the optical element illustrated in FIGS. 6-8.

FIG. 10 depicts another plot of intensity over beam angle for several different embodiments of optical element 140 illustrated in FIGS. 6-8. Plotline 183 illustrates the intensity over angle for optical element 140 depicted in FIGS. 6-8 where the surfaces of each annular shell element 151-154 are completely absorptive. Plotline 182 illustrates the intensity over angle for optical element 140 depicted in FIGS. 6-8 where the surfaces of each annular shell element 151-154 are specularly reflective with 25% reflectivity. Plotline 181 illustrates the intensity over angle for optical element 140 depicted in FIGS. 6-8 where the surfaces of each annular shell element 151-154 are diffusely reflective with 25% reflectivity. As illustrated, with completely absorptive annular shell elements, a very sharp, narrow beam angle is generated. When the annular shell elements are specularly reflective, the beam angle is broadened, however a relatively sharp transition occurs near 35 degrees. When the annular shell elements are diffusely reflective, the beam angle is also broadened, however, sharp transitions in the output beam are reduced significantly. In this manner, the output beam profile may be shaped as desired by employing annular shell elements with different reflective characteristics. In some embodiments, the inner facing surfaces of an annular shell element exhibit a different reflectivity than an outer facing surface of the same element.

In some embodiments, any of the annular shell elements may be perforated to allow some amount of light to pass through the shell. In this manner, the output beam profile may be shaped as desired. By allowing some amount of light to leak through the shell, sharp transitions in the output beam may be reduced. Perforations may include slit, hole, or tab features constructed as part of the shell element. In particular, tab features may be desirable, as they may be adjusted to further modify the output beam of an LED based illumination module after assembly.

In some embodiments, any of the annular shell elements presented herein may include a color converting material (e.g., phosphor material) or a color filtering material (e.g., dichroic material, Lee filter, etc.). For example, a color filtering material may be included to achieve a desired illumination effect.

The proportion of light emitted from LED based illumination device 100 that is directed to the output port 143 compared to the hollow shell reflector 142 may be altered based on any of the shape of the annular shell elements, coatings applied to surfaces of the annular shell elements, and particles embedded in any of the annular shell elements. For example, any of the annular shell elements may include a material loaded with scattering particles (e.g., titanium dioxide particles, etc.), or may be coated by a diffuse material (e.g., a white powder coating).

Similarly, the angular distribution of light emitted from output port 143 may be altered based on any of the shape of the annular shell elements, coatings applied to surfaces of the annular shell elements, and particles embedded in the annular shell elements. In another example, a portion of any annular shell element may be selectively constructed with a different surface treatment (e.g., surface roughening) to promote light scattering in the selected portion.

In addition, the angular distribution of light emitted from output port 143 may also be altered based on any of the shape, coatings, and particles embedded in the hollow shell reflector 142. In some examples a portion of an interior surface of the hollow shell reflector is coated with a reflective material.

Figure 11:
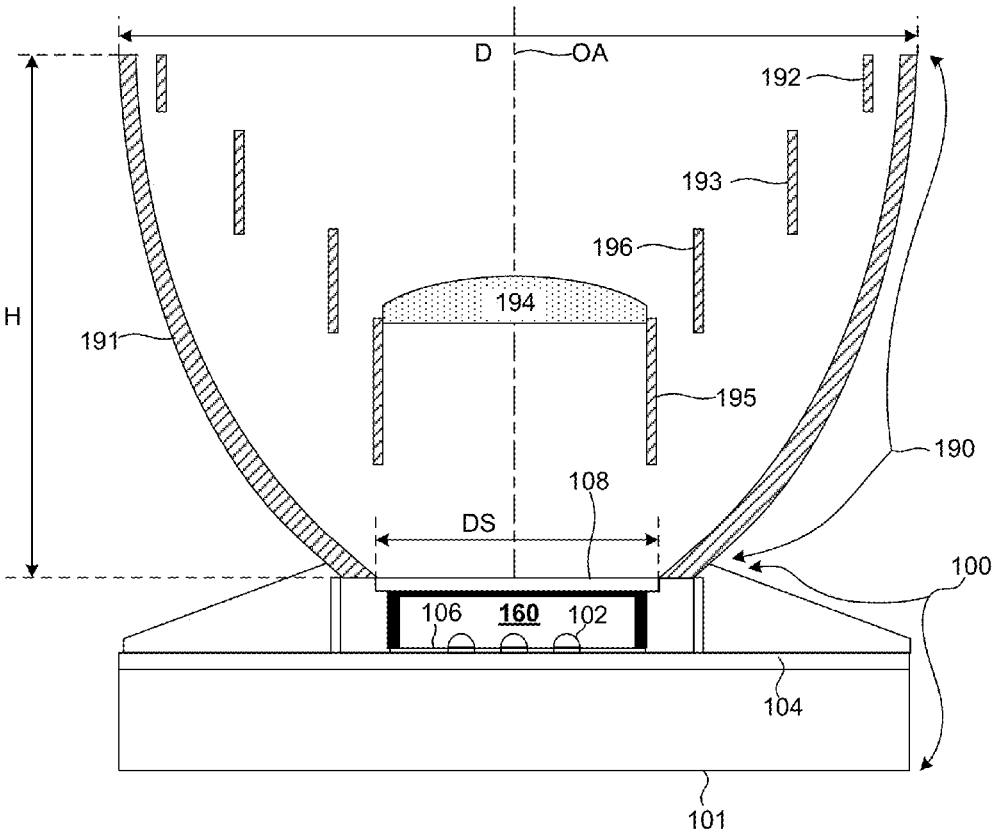
FIG. 11 illustrates a cross-sectional, side view of a luminaire including an optical element in another embodiment.
Figure 12:
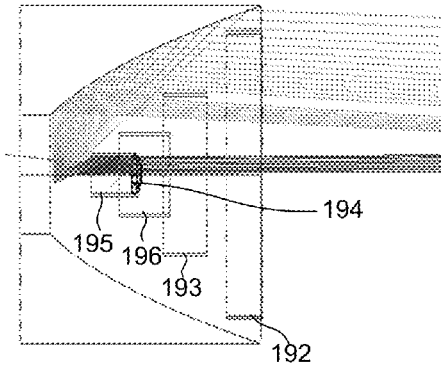
FIG. 12 is a plot illustrating a ray trace diagram of the optical element depicted in FIG. 11.

FIG. 11 illustrates a cross-sectional, side view of luminaire 150 including an optical element 190 in another embodiment. As illustrated, optical element 190 includes a lens element 194. By way of example, lens element 194 may be a Fresnel lens, a spherical lens, an aspherical lens, etc. In some embodiments, lens 194 may include a color converting material (e.g., phosphor material) or a color filtering material (e.g., dichroic material, Lee filter, etc.). For example, a color filtering material may be included in portions of lens 194 to achieve a desired illumination effect. As illustrated, elements 192, 193, 195, and 196 are annular shell elements. The illustrated embodiment is provided by way of example. In general, any lens element may be included within the hollow shell reflector that includes annular shell elements.

In the depicted embodiment, lens 194 is located at the end of annular shell element 195. In some other examples, lens 194 is located within annular shell element 195. In some other examples, lens 194 is located at the end of annular shell element 195 closest to output window 108. In the depicted embodiment, hollow shell reflector 191 has a height, H, of 67 millimeters and an exit diameter, D, of 108 millimeters, and an input diameter of 6 millimeters. Optical element 190 is able to generate a narrow output beam in this configuration. As illustrated in the ray-trace diagram illustrated in FIG. 12, a narrow output beam is generated by light captured by annular shell element 195 and collimated by lens element 194.

Figure 13:
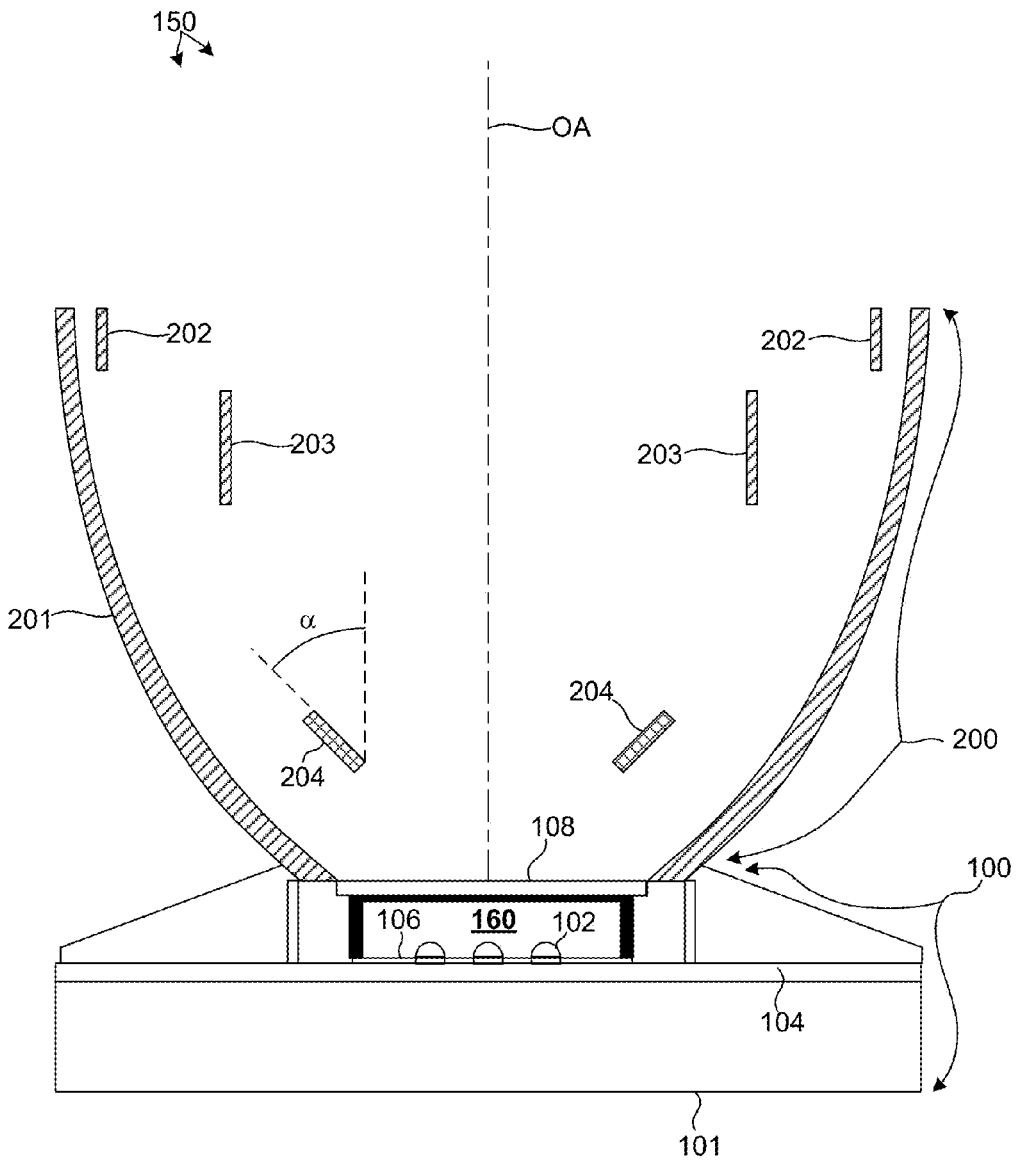
FIG. 13 illustrates a cross-sectional, side view of a luminaire including an optical element in another embodiment.

FIG. 13 illustrates a cross-sectional, side view of luminaire 150 including an optical element 200 in another embodiment. As illustrated, optical element 200 includes an annular shell element 204 with a cross-sectional profile oriented at a non-zero angle, $\alpha$, with respect to an optical axis, OA, of the optical element 200 and/or luminaire 150. In this manner, light emitted from LED based illumination module 100 that is incident on externally facing surface 204A of annular shell element 204 is redirected toward hollow shell reflector 201, and subsequently redirected toward the center of the field of light emitted from luminaire 150. Annular shell elements 202 and 203 are oriented parallel to the optical axis. The illustrated embodiment is provided by way of example. In general, any annular shell element included within hollow shell reflector 201 may be oriented at an angle with respect to the optical axis, OA.

Figure 14:
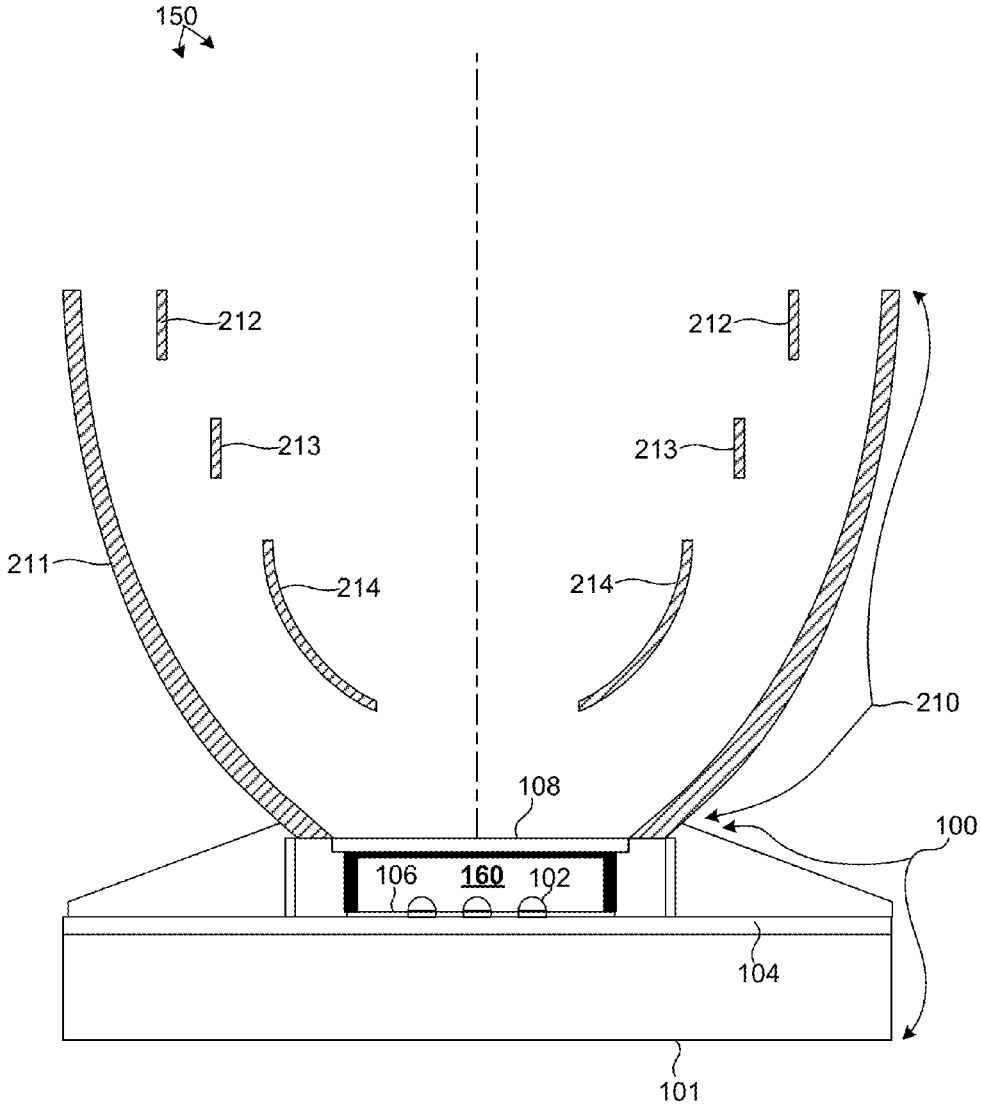
FIG. 14 illustrates a cross-sectional, side view of a luminaire including an optical element in another embodiment.

FIG. 14 illustrates a cross-sectional, side view of luminaire 150 including an optical element 210 in another embodiment. As illustrated, optical element 210 includes an annular shell element 214 with a curved cross-sectional profile. As illustrated, annular shell elements 212 and 213 have linear cross sectional profiles. The illustrated embodiment is provided by way of example. In general any annular shell element included within hollow shell reflector 211 may include a curved cross sectional profile.

Figure 15:
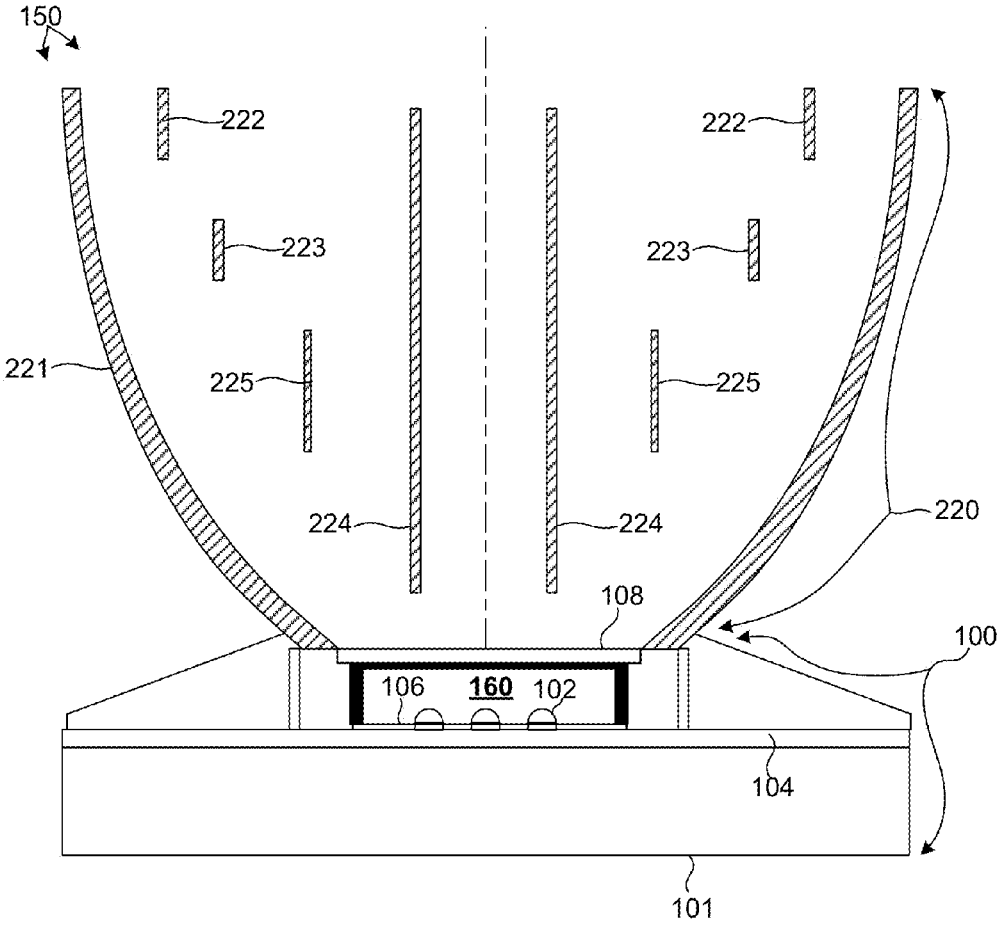
FIG. 15 illustrates a cross-sectional, side view of a luminaire including an optical element in another embodiment.
Figure 16:
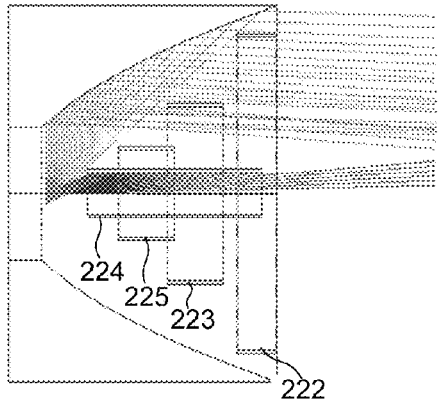
FIG. 16 is a plot illustrating a ray trace diagram of the optical element depicted in FIG. 15.

FIG. 15 illustrates a cross-sectional, side view of luminaire 150 including an optical element 220 in another embodiment. As illustrated, optical element 220 includes a hollow shell reflector 221 and an annular shell element 224 that extends closer to the output window 108 than the other annular shell elements and has a height greater than the other annular shell elements (e.g., annular shell elements 222, 223, and 225). Optical element 220 is able to generate a narrow output beam in this configuration. As illustrated in the ray-trace diagram illustrated in FIG. 16, a narrow output beam is generated by light captured by annular shell element 224.

Figure 17:
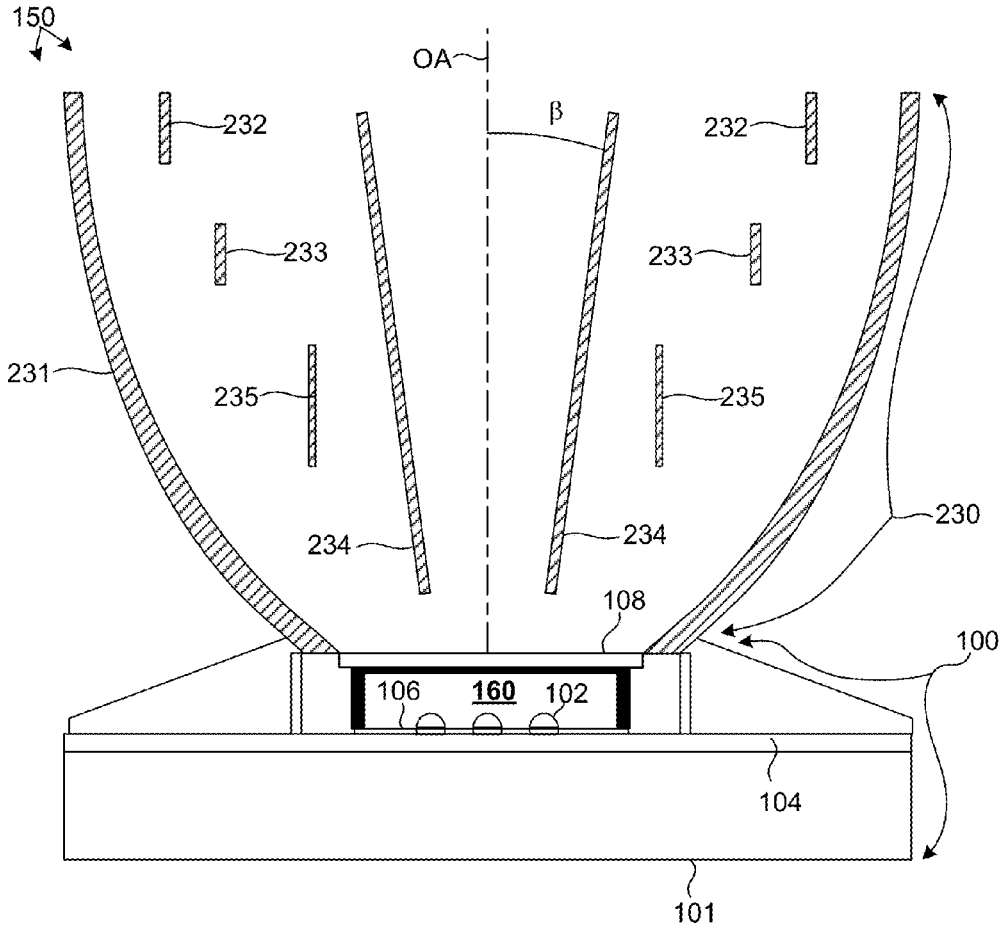
FIG. 17 illustrates a cross-sectional, side view of a luminaire including an optical element in another embodiment.
Figure 18:
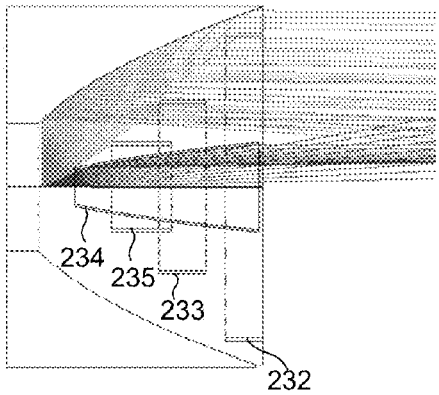
FIG. 18 is a plot illustrating a ray trace diagram of the optical element depicted in FIG. 17.

FIG. 17 illustrates a cross-sectional, side view of luminaire 150 including an optical element 230 in another embodiment. As illustrated, optical element 230 includes a hollow shell reflector 231 and an annular shell element 234 that extends closer to the output window 108 than the other annular shell elements and has a height greater than the other annular shell elements (e.g., annular shell elements 232, 233, and 235). In addition, annular shell element 234 has a conical shape with a reflective internal surface disposed at an angle, $\beta$, with respect to the optical axis, OA, of luminaire 150. Optical element 230 is able to generate a narrow output beam in this configuration. As illustrated in the ray-trace diagram illustrated in FIG. 18, a narrow output beam is generated by light captured by tapered, annular shell element 234.

Figure 19:
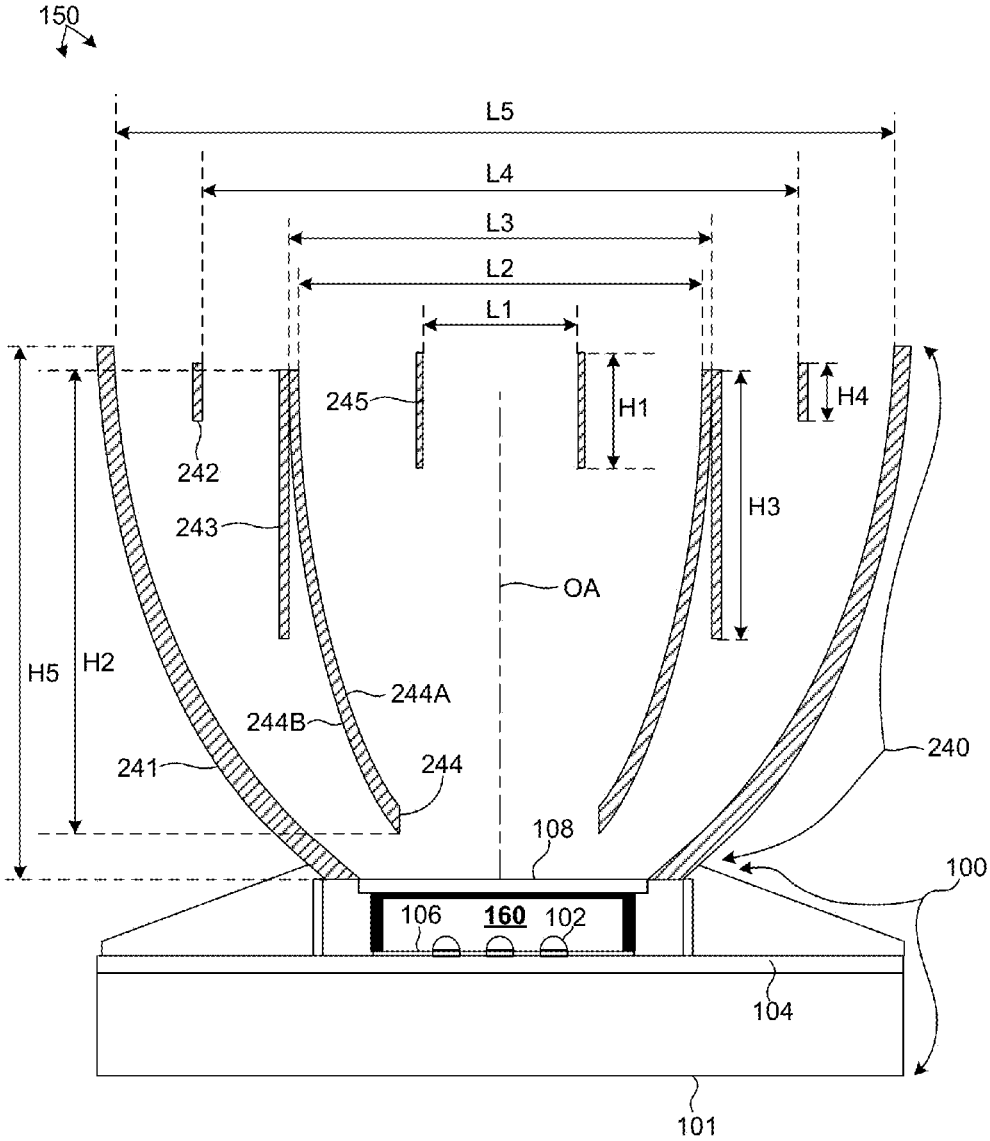
FIG. 19 illustrates a cross-sectional, side view of a luminaire including an optical element in another embodiment.

FIG. 19 illustrates a cross-sectional, side view of luminaire 150 including an optical element 240 in another embodiment. As illustrated, optical element 240 includes a hollow shell reflector 241 and a curved, annular shell element 244 that extends closer to the output window 108 than the other annular shell elements and has a height greater than the other annular shell elements (e.g., annular shell elements 242, 243, and 245). In addition, annular shell element 244 has a curved shape with a reflective inward facing (i.e., toward the optical axis) surface 244A and an absorptive outward facing (i.e., away from the optical axis) surface 244B.

As depicted in FIG. 19, the perimeter of the optical element 240 increases in size from a perimeter at the input port to a maximum perimeter. In one embodiment, hollow shell reflector 241 has a height, H5, of 40 millimeters, and a diameter at the output, L5, of 70 millimeters. In addition, optical element 240 includes a number of annular shell elements 242-245 located within the volume of hollow shell reflector 241. In the depicted embodiment, annular shell elements 242-245 are approximately centered on an optical axis, OA, of the luminaire 150.

Annular shell element 245 has a diameter, L1, of 16 millimeters and a height, H1, of 14 millimeters. In the depicted embodiment, the top of annular shell element 245 is located flush with the top of hollow shell reflector 241. However, in some other embodiments, annular shell element 245 may protrude above the top of hollow shell reflector 241, or be recessed below the top of hollow shell reflector 241. Curved, annular shell element 244 has a diameter, L2, equal to 36 millimeters at the top, and a height, H2, of 33 millimeters. As depicted in FIG. 19, the top of annular shell element 244 is located below the top of hollow shell reflector 241. However, in some other embodiments, the top of annular shell element 244 is located flush with the top of hollow shell reflector 241. Annular shell element 243 has a diameter, L3, only slightly larger than the diameter, L2, of annular shell element 244, so that annular shell element 243 is in contact with annular shell element 244 at the top of annular shell element 244. In this manner, a small amount of light emitted from LED based illumination device 100 is trapped between annular shell element 243 and 244. Annular shell element 243 has been found to further narrow the field of light emitted from luminaire 150. However, in some other embodiments, annular shell element 243 is not present, and thus may be considered optional. As depicted in FIG. 19, the top of annular shell element 243 is located flush with the top of annular shell element 244. However, in some embodiments, the top of annular shell element 243 extends above annular shell element 244. Annular shell element 242 has a diameter, L4, of 53 millimeters and a height, H4, of 11 millimeters. In the depicted embodiment, the top of annular shell element 242 is located below the top of hollow shell reflector 241, but above the top of annular shell element 244. However, in some other embodiments, the top of annular shell element 242 is flush with the top of hollow shell reflector 241.

Any of the optical elements presented herein may be constructed from transmissive materials (e.g., optical grade PMMA, Zeonex, etc.) or reflective materials (e.g., Miro®, polished aluminum, Vikuiti™ ESR, Lumirror™ E60L, MCPET, or PTFE). In addition, or in the alternative, any of the optical elements presented herein may be coated with one or more reflective coatings. Any of the optical elements presented herein may be formed by a suitable process (e.g., molding, extrusion, casting, machining, drawing, etc.). Any of the optical elements presented herein may be constructed from one piece of material or from more than one piece of material joined together by a suitable process (e.g., welding, gluing, soldering, etc.).

Although certain specific embodiments are described above for instructional purposes, the teachings of this patent document have general applicability and are not limited to the specific embodiments described above. For example, optical element 140 may be a replaceable component that may be removed and reattached to LED based illumination module 100. In this manner, different shaped reflectors may be interchanged with one another by a user of luminaire 150 (e.g., maintenance personnel, fixture supplier, etc.). For example, any component of color conversion cavity 160 may be patterned with phosphor. Both the pattern itself and the phosphor composition may vary. In one embodiment, the illumination device may include different types of phosphors that are located at different areas of a light mixing cavity 160. For example, a red phosphor may be located on either or both of the insert 107 and the bottom reflector insert 106 and yellow and green phosphors may be located on the top or bottom surfaces of the window 108 or embedded within the window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 130 may be a single component. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. An apparatus comprising:

an LED based illumination device operable to emit light in a Lambertian pattern over a surface of an output window; and an optical element coupled to receive the light emitted from the output window of the LED based illumination device, the optical element having an input port and an output port, wherein a perimeter of the optical element increases in size from the input port to a maximum perimeter, the optical element comprising:

a hollow shell reflector having a first height;

a first annular shell element having a first radius and a second height that is less than the first height, the first annular shell element disposed within the hollow shell reflector; and a second annular shell element having a second radius and a third height, the second annular shell element disposed within the hollow shell reflector at a location closer to the input port of the optical element than a location of the first annular shell element, wherein the second radius is less than the first radius.

2. The apparatus of claim 1, wherein the second height of the first annular shell element is less than the third height of the second annular shell element.

3. The apparatus of claim 1, further comprising at least one additional annular shell element disposed within the hollow shell reflector at a location farther from the input port of the optical element than the location of the first annular shell element and having a radius that is greater than the first radius.

4. The apparatus of claim 1, wherein the amount of light emitted from the LED based illumination device passes through the input port of the optical element, wherein the input port is sized to match the output window of the LED based illumination device.

5. The apparatus of claim 1, wherein the first annular shell element and the second annular shell element include materials with scattering particles.

6. The apparatus of claim 1, wherein each of the first annular shell element and the second annular shell element includes inner and outer facing surfaces, and wherein light is reflected from the inner and outer facing surfaces.

7. The apparatus of claim 1, wherein the first annular shell element and the second annular shell element include perforations.

8. The apparatus of claim 1, wherein the second annular shell element has a curved cross-sectional profile.

9. The apparatus of claim 1, wherein the second annular shell element has a cross-sectional profile oriented at a non-zero angle with respect to an optical axis of the optical element.

10. The apparatus of claim 1, wherein the optical element is replaceably coupled to the LED based illumination device.

11. The apparatus of claim 1, further comprising:

a lens element disposed within the hollow shell reflector.

12. An optical element, comprising:

an input port configured to receive light emitted from a planar light emitting area of an LED based illumination device;

an output port configured to emit an amount of light;

a hollow shell reflector having a first height;

a first annular shell element having a first radius and a second height that is less than the first height, the first annular shell element disposed within the hollow shell reflector; and a second annular shell element having a second radius and a third height that is less than the first height, the second annular shell element disposed within the hollow shell reflector at a location closer to the input port of the optical element than a location of the first annular shell element, wherein the second radius is less than the first radius.

13. The optical element of claim 12, wherein the second height of the first annular shell element is less than the third height of the second annular shell element.

14. The optical element of claim 12, further comprising at least one additional annular shell element disposed within the hollow shell reflector at a location farther from the input port of the optical element than the location of the first annular shell element and having a radius that is greater than the first radius.

15. The optical element of claim 12, wherein the second annular shell element has a curved cross-sectional profile.

16. The optical element of claim 12, wherein the second annular shell element has a cross-sectional profile oriented at a non-zero angle with respect to an optical axis of the optical element.

17. The optical element of claim 12, wherein the hollow shell reflector is disposed at the input port of the optical element and extends to the output port.

18. An optical element, comprising:

an input port configured to receive light emitted from a planar light emitting area of an LED based illumination device;

an output port configured to emit an amount of light;

a hollow shell reflector having a first height;

a first annular shell element having a first diameter and a second height that is less than the first height;

a curved, annular shell element having a second diameter that is less than the first diameter, and a third height that is greater than the second height and less than the first height;

a second annular shell element having a third diameter that is less than the second diameter and a fourth height that is less than the third height, wherein the curved, annular shell element and the first annular shell element and the second annular shell elements are disposed within the hollow shell reflector.

19. The optical element of claim 18, wherein the curved, annular shell element includes an inward facing surface and an outward facing surface, wherein the inward facing surface is more reflective than the outward facing surface.

20. The optical element of claim 18, wherein a top of the second annular shell element is flush with a top of the hollow shell reflector.

* * * * *